US011203888B2

(12) United States Patent
Farris et al.

(10) Patent No.: US 11,203,888 B2
(45) Date of Patent: Dec. 21, 2021

(54) VEHICLE HOOD LATCHES

(71) Applicant: Gecom Corporation, Novi, MI (US)

(72) Inventors: Bryan Farris, Livonia, MI (US); Brian Kepler, Dearborn, MI (US)

(73) Assignee: Gecom Corporation, Novi, MI (US)

( * ) Notice: Subject to any disclaimer, the term of this patent is extended or adjusted under 35 U.S.C. 154(b) by 44 days.

(21) Appl. No.: 16/743,703

(22) Filed: Jan. 15, 2020

(65) Prior Publication Data

US 2020/0149326 A1 May 14, 2020

Related U.S. Application Data

(62) Division of application No. 14/550,130, filed on Nov. 21, 2014, now Pat. No. 10,577,842.

(60) Provisional application No. 61/907,873, filed on Nov. 22, 2013, provisional application No. 61/989,258, filed on May 6, 2014.

(51) Int. Cl.

| | |
|---|---|
| ***E05B 83/24*** | (2014.01) |
| ***E05B 85/26*** | (2014.01) |
| ***E05B 77/08*** | (2014.01) |

(52) U.S. Cl.

CPC ..... *E05B 83/24* (2013.01); *E05B 77/08* (2013.01); *E05B 85/26* (2013.01); *Y10S 292/14* (2013.01); *Y10T 29/49826* (2015.01); *Y10T 292/1047* (2015.04); *Y10T 292/1075* (2015.04)

(58) Field of Classification Search

CPC ..... E05B 83/24; E05B 85/26; E05B 77/08; E05B 83/243; Y10T 29/49826; Y10T 292/1075; Y10T 292/1047; Y10S 292/14

USPC ..... 267/154–157

See application file for complete search history.

(56) References Cited

U.S. PATENT DOCUMENTS

| | | | | | |
|---|---|---|---|---|---|
| 2,892,653 | A | * | 6/1959 | Harman | E05B 85/28 292/216 |
| 3,421,785 | A | * | 1/1969 | Slattery | E05B 85/243 292/216 |
| 3,572,793 | A | * | 3/1971 | Cole | E05B 83/16 292/216 |
| 3,666,305 | A | * | 5/1972 | Schlichter | E05B 85/247 292/48 |
| 3,695,659 | A | * | 10/1972 | Gionet | E05B 83/16 292/216 |
| 3,730,575 | A | * | 5/1973 | Arlauskas | E05B 83/16 292/216 |
| 3,917,330 | A | * | 11/1975 | Quantz | E05B 81/14 292/216 |
| 4,172,768 | A | * | 10/1979 | Cerdan | E05B 85/26 292/216 |
| 4,703,961 | A | * | 11/1987 | Weinerman | E05C 3/24 292/216 |
| 4,875,724 | A | * | 10/1989 | Gruber | E05B 83/16 292/216 |

(Continued)

FOREIGN PATENT DOCUMENTS

| | | | |
|---|---|---|---|
| CN | 2049252 | U | 12/1989 |
| CN | 100422497 | C | 10/2008 |

(Continued)

*Primary Examiner* — Carlos Lugo

(74) *Attorney, Agent, or Firm* — Barnes & Thornburg LLP

(57) ABSTRACT

Latches including a slot having a length that allows a striker of the latch to move from a normal closed position downwardly toward the closed bottom of the slot into an over travel position.

11 Claims, 9 Drawing Sheets

(56) References Cited

U.S. PATENT DOCUMENTS

| | | | | | |
|---|---|---|---|---|---|
| 4,936,611 | A * | 6/1990 | Palvolgyi | E05B 83/16 | 292/216 |
| 4,961,601 | A * | 10/1990 | Lindholm | E05B 83/16 | 292/216 |
| 4,978,153 | A * | 12/1990 | Hirsch | B04B 7/06 | 292/201 |
| 5,150,933 | A * | 9/1992 | Myslicki | E05B 83/16 | 292/216 |
| 6,106,033 | A * | 8/2000 | Ruckert | E05B 83/16 | 292/216 |
| 6,149,210 | A | 11/2000 | Hunt et al. | | |
| 6,581,987 | B1 * | 6/2003 | Gentile | E05B 83/24 | 292/216 |
| 6,808,213 | B2 * | 10/2004 | Heller | E05B 81/20 | 292/201 |
| 7,261,339 | B2 * | 8/2007 | Kiehl | E05B 85/26 | 292/201 |
| 7,416,229 | B2 * | 8/2008 | Stefanie | E05B 81/14 | 292/201 |
| 8,480,138 | B2 * | 7/2013 | Bendel | E05B 85/26 | 292/201 |
| 8,608,212 | B2 | 12/2013 | Takeda | | |
| 8,672,385 | B2 | 3/2014 | Matsumoto et al. | | |
| 9,151,092 | B2 | 10/2015 | Scholz et al. | | |
| 9,187,936 | B2 * | 11/2015 | Kim | E05B 83/24 | |
| D801,168 | S * | 10/2017 | Vavrinak | D8/402 | |
| 10,273,726 | B2 * | 4/2019 | Park | E05B 83/24 | |
| 2004/0239124 | A1 | 12/2004 | Larsen et al. | | |
| 2007/0029814 | A1 | 2/2007 | Coleman et al. | | |
| 2010/0052341 | A1 | 3/2010 | Taurasi et al. | | |
| 2010/0072775 | A1 | 3/2010 | Tanoi | | |
| 2011/0012376 | A1 * | 1/2011 | Hunt | E05B 77/36 | 292/216 |
| 2012/0061977 | A1 | 3/2012 | Takeda | | |
| 2014/0015258 | A1 | 1/2014 | Barczynski et al. | | |
| 2014/0062098 | A1 * | 3/2014 | Kim | E05B 83/24 | 292/28 |
| 2014/0132008 | A1 * | 5/2014 | Bendel | E05B 77/06 | 292/92 |
| 2014/0319848 | A1 * | 10/2014 | Fannon | E05B 83/24 | 292/122 |

FOREIGN PATENT DOCUMENTS

| | | | | |
|---|---|---|---|---|
| CN | 102400615 | A | 4/2012 | |
| DE | 4224982 | C1 | 2/1994 | |
| DE | 102007045716 | A1 * | 4/2008 | E05B 85/243 |
| DE | 102008025604 | A1 | 12/2009 | |
| DE | 102011003808 | A1 * | 8/2012 | E05B 83/24 |
| EP | 1842992 | A2 * | 10/2007 | E05B 83/24 |
| EP | 2168799 | A2 | 3/2010 | |
| EP | 2341204 | A2 | 7/2011 | |
| FR | 2863297 | A1 | 6/2005 | |
| FR | 2863298 | A1 * | 6/2005 | E05B 83/24 |
| GB | 1086378 | A * | 10/1967 | E05B 47/0607 |
| JP | 58029236 | Y2 | 6/1983 | |
| JP | 2012062649 | A | 3/2012 | |
| JP | 2012211460 | A | 11/2012 | |
| WO | 2012100328 | A1 | 8/2012 | |

* cited by examiner

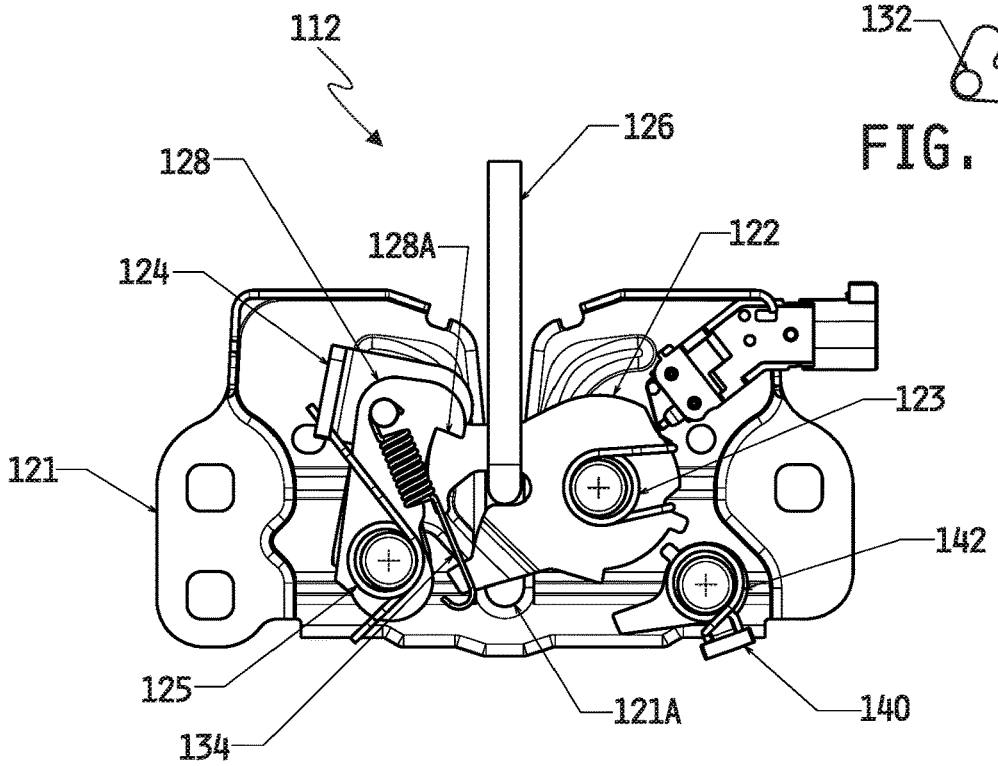
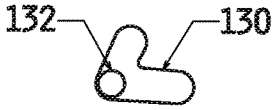
FIG. 10A
FIG. 10
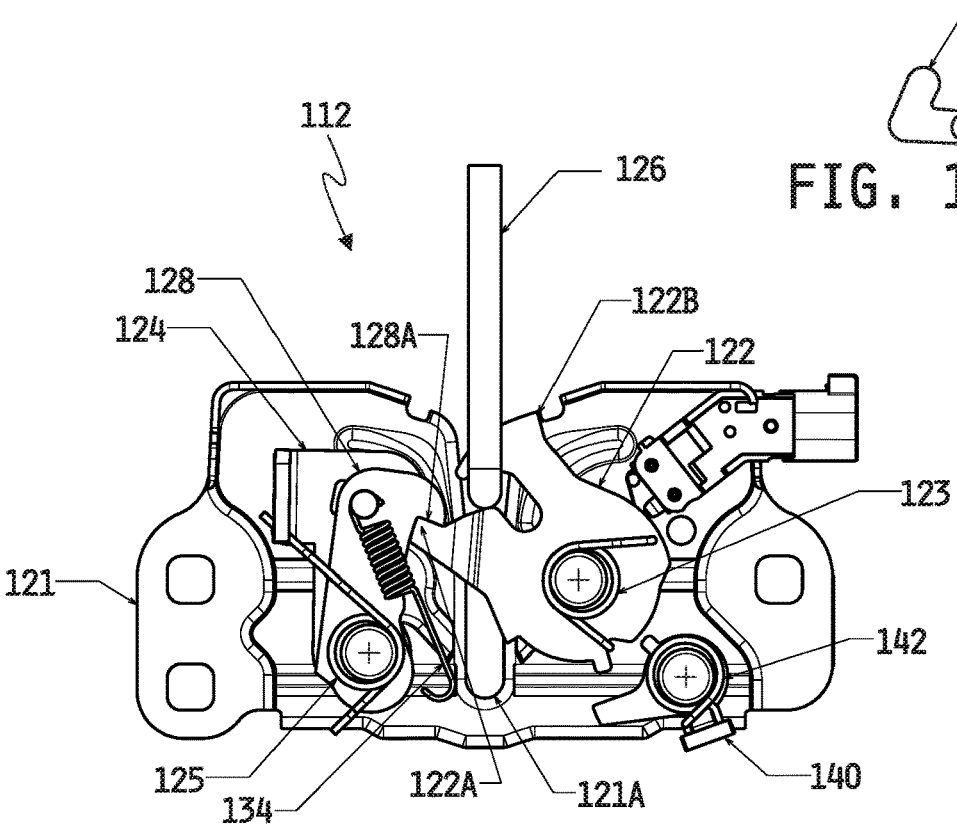
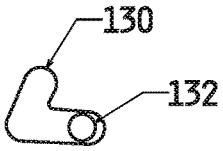
FIG. 11A
FIG. 11

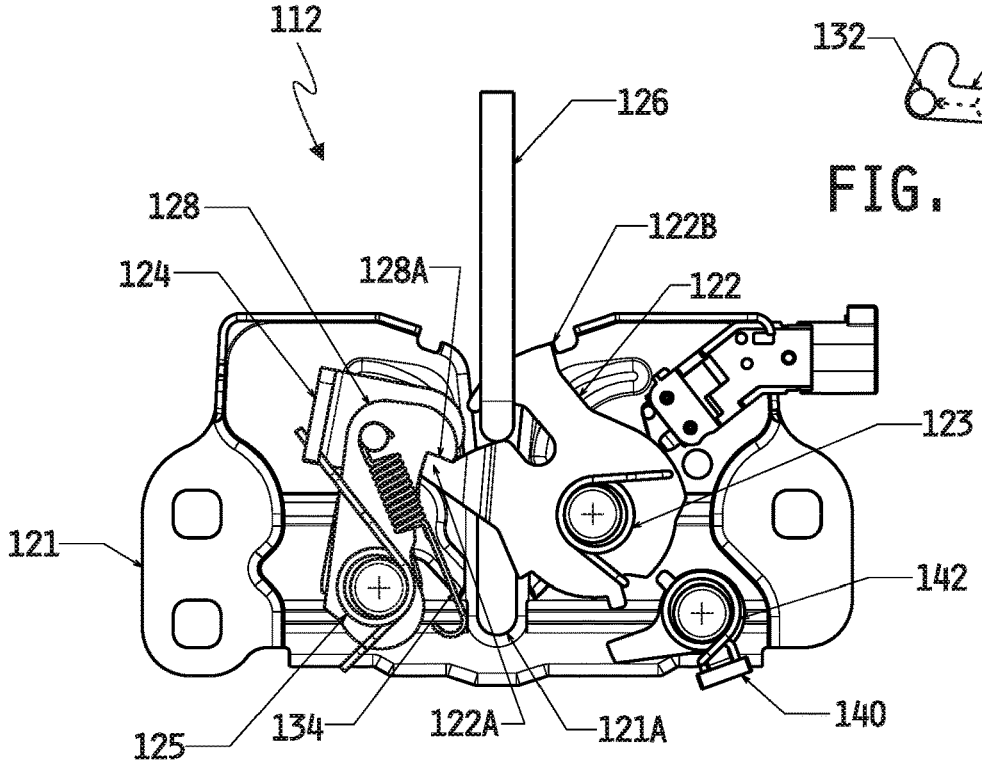
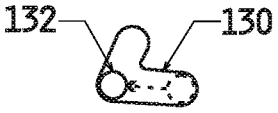
FIG. 12A
FIG. 12
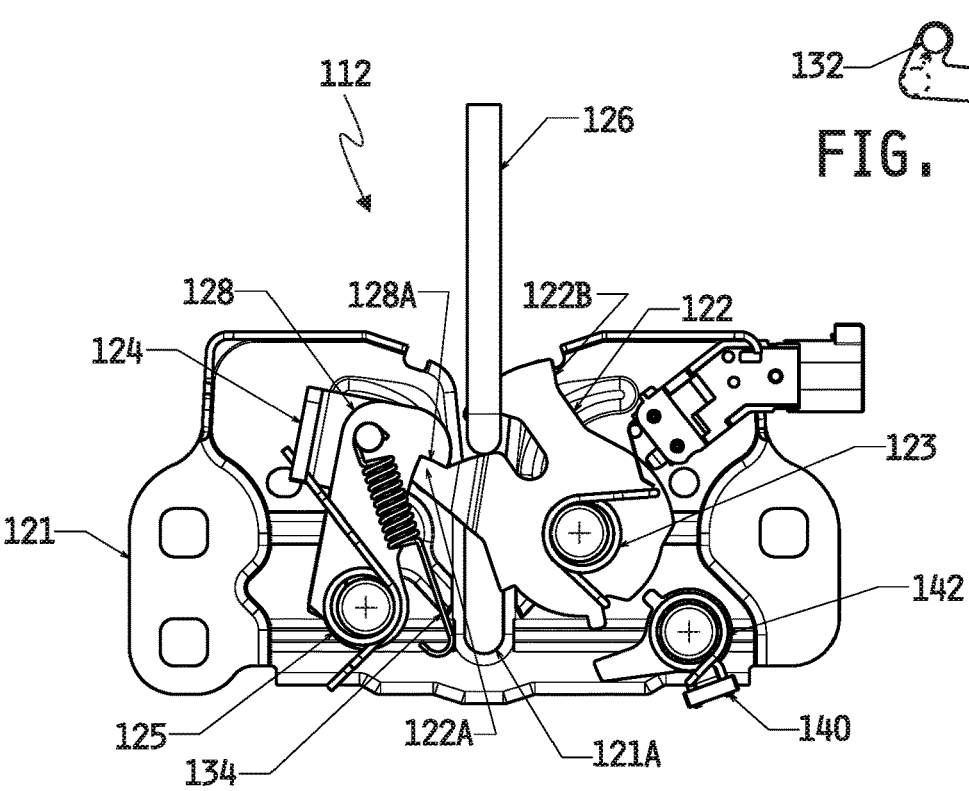
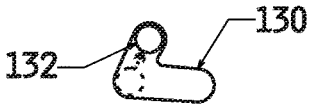
FIG. 13A
FIG. 13

VEHICLE HOOD LATCHES

CROSS REFERENCE TO RELATED APPLICATIONS

This application is a divisional of U.S. Non-Provisional patent application Ser. No. 14/550,130, filed Nov. 21, 2014, which claims priority to and the benefit of U.S. Provisional Patent Application No. 61/907,873, filed 22 Nov. 2013, and U.S. Provisional Patent Application No. 61/989,258, filed 6 May 2014, the disclosures of which are now expressly incorporated herein by reference.

TECHNICAL FIELD

The present disclosure relates generally to vehicle hood latch systems, and more specifically to hood latch systems offering protection to objects during a collision.

BACKGROUND

Under a vehicle's front hood there may be underlying hard points, such as the engine or automobile body. In the event of a collision with an object, such hard points may exacerbate damage to the object. For example in a collision between the vehicle and a pedestrian, the hard points may exacerbate the injuries suffered by the pedestrian. Attempts have been made in the industry to modify packages under the hood to address these concerns; however, previous attempts require extensive styling and functional tradeoffs based on packaging requirements or include complicated electromechanical sensing and release systems.

SUMMARY

The present application discloses one or more of the features recited in the appended claims and/or the following features which, alone or in any combination, may comprise patentable subject matter.

According to an aspect of the present disclosure, a latch may include a housing, a ratchet, a pawl, and a striker. The housing may have a fishmouth. The fishmouth may define a length between an open top end of the fishmouth and a closed bottom end of the fishmouth. The striker may be received within the fishmouth. The ratchet and the pawl may cooperate to selectively retain the striker in the fishmouth. The ratchet may be movable between a closed position wherein the striker is retained in the fishmouth and an open position wherein the striker is free to exit the fishmouth. The pawl may be moveable between a locking position wherein the pawl keeps the ratchet in the closed position and an unlocked position wherein the pawl permits the movement of the ratchet out of the closed position. The ratchet may be biased to the open position and the pawl may be biased to the locking position. The pawl may include a lower appendage that blocks the ratchet from moving past the closed position, thereby retaining the striker in the closed position. The closed position may be an intermediate position between the open end and the closed end of the fishmouth.

In some embodiments, the pawl and the ratchet are disposed on opposing sides of the fishmouth. In some embodiments, the pawl is movably attached to the frame. In some embodiments, the ratchet is movably attached to the frame. In some embodiments, the striker is attached to the hood of a vehicle, and the frame is attached to the vehicle.

In some embodiments, the pawl is biased by a bias member comprising a spring. In some embodiments, the ratchet is biased by a bias member comprising a spring. In some embodiments, the pawl bias spring comprises a torsion spring. In some embodiments, the ratchet bias spring comprises a torsion spring.

In some embodiments, the latch further includes a block lever. In some embodiments, the block lever cooperates with the pawl and the ratchet to retain the ratchet in the closed position. In some embodiments, the ratchet is movable downwardly out of the closed position to an over travel position to allow the striker to move downwardly toward the closed end of the fishmouth.

According to another aspect of the present disclosure, a method of latching may include the steps of providing a frame defining a slot having an open top, a closed bottom and a length between the open top and the closed bottom, operably attaching together a frame and a pawl, operably attaching together a frame and a ratchet, receiving within the slot a striker, seating the striker within the ratchet in a closed position, retaining the ratchet in the closed position, and allowing the ratchet to release the striker to travel downwardly from the closed position to an over travel position. In some embodiments, the method further includes the steps of operably attaching together the frame and a vehicle and operably attaching together the striker and a hood of the vehicle.

According to another aspect of the present disclosure, a latch may include a housing, a ratchet, a primary pawl, a secondary pawl, and a striker arranged to be received within the fishmouth. The housing may have a fishmouth. The fishmouth may define a length between an open top end of the fishmouth and a closed bottom end of the fishmouth. The latch may be movable between a fully closed position where the ratchet and the primary pawl cooperate to selectively retain the striker in the fishmouth, a partially closed position where the ratchet and the secondary pawl cooperate to selectively retain the striker in the fishmouth, and an open position where the striker is not retained in the fishmouth.

In some embodiments, the ratchet is movable between a first-locked position, a second-locked position, an unlocked position, and an over travel position. The primary pawl is movable between a locked position and an unlocked position. The secondary pawl is movable between a locked position and an unlocked position. The ratchet is in the first-locked position, the primary pawl is in the locked position, and the secondary pawl is in the locked position when the latch is in the fully closed position.

In some embodiments, the ratchet is in the second-locked position, the primary pawl is in the locked position, and the secondary pawl is in the locked position when the latch is in the partially closed position. In some embodiments, the ratchet is in the unlocked position, the primary pawl is in the locked position, and the secondary pawl is in the locked position when the latch is in the partially closed position.

In some embodiments, the primary pawl includes a pawl tip and the ratchet includes a ratchet upper tip and the ratchet upper tip engages the pawl tip of the primary pawl to retain the ratchet in the first-locked position when the latch is in the fully closed position. In some embodiments, the primary pawl is moved from the locked position to the unlocked position a first time to cause the ratchet to move from the first-locked position to the second-locked position.

In some embodiments, the secondary pawl includes a secondary tip and the ratchet includes a ratchet lower tip. The ratchet lower tip engages the secondary tip of the secondary pawl to retain the ratchet in the second-locked position when the latch is in the partially closed position.

In some embodiments, the primary pawl is moved from the locked position to the unlocked position a second time to cause the ratchet to move from the second-locked position to the unlocked position. In some embodiments, the primary pawl moves from the locked position to the unlocked position in response to a pawl release being activated and moves from the unlocked position to the locked position when the pawl release is deactivated. In some embodiments, the secondary pawl and the primary pawl are arranged to rotate about a pawl axis and the pawl tip of the secondary pawl is axially spaced apart from the pawl tip of the primary pawl.

In some embodiments, the primary pawl is formed to include a primary slot. The secondary pawl is formed to include a secondary hole. The latch system further includes a pin extending through the secondary hole and primary slot. The pin is positioned in the primary slot to allow the primary pawl to move between the locked and unlocked positions without causing the secondary pawl to move between the locked and unlocked positions when the latch is in the fully closed position. In some embodiments, the pin is positioned in the primary slot to couple the primary pawl and the secondary pawl together such that the movement of the primary pawl between the locked and unlocked positions causes movement of the secondary pawl between the locked and unlocked positions when the latch is in the partially closed position.

In some embodiments, the ratchet is arranged to rotate about a ratchet axis and the ratchet lower tip is axially spaced apart from the ratchet upper tip. In some embodiments, the pawl and the ratchet are disposed on opposing sides of the fishmouth.

In some embodiments, the pawl is movably attached to the housing. In some embodiments, wherein the secondary pawl is movably attached to the housing. In some embodiments, the ratchet is movably attached to the housing.

In some embodiments, the striker is attached to the hood of a vehicle and the housing is attached to the vehicle. In some embodiments, the primary pawl is biased by a primary bias member into the locked position. In some embodiments, the primary bias member includes a torsion spring.

In some embodiments, the secondary pawl is biased by a secondary bias member into the locked position. In some embodiments, the secondary bias member includes a tension spring.

In some embodiments, the ratchet is biased by a ratchet bias member into the unlocked position. In some embodiments, the ratchet bias member includes a torsion spring.

In some embodiments, the ratchet is rotatable out of the first-locked position to an over travel position to allow the striker to move downwardly toward the closed end of the fishmouth from a closed position. In some embodiments, the striker is allowed to move downwardly by about 10 millimeters to about 30 millimeters from the closed position to the over travel position. In some embodiments, the striker is allowed to move downwardly by about 20 millimeters from the closed position to the over travel position.

In some embodiments, the latch further includes a toggle lever. In some embodiments, the toggle lever cooperates with the ratchet to block the striker from moving downwardly toward the closed end of the fishmouth.

In some embodiments, the toggle lever is movable between a neutral position, a blocking position, and a bypass position. The ratchet is allowed to rotate when the toggle lever is in the neutral position. The ratchet is blocked from rotating when the toggle lever is in the blocking position and the ratchet is engaged with the toggle lever.

In some embodiments, the toggle lever is biased by a toggle bias member into the neutral position. In some embodiments, the toggle bias member includes a torsion spring.

In some embodiments, the toggle lever moves through the neutral position when moving between the blocking and bypass positions. In some embodiments, the ratchet engages the toggle lever to move the toggle lever to the bypass position when the ratchet is moved from the first-locked position to the open position.

In some embodiments, the ratchet engages the toggle lever to move the toggle lever to the blocking position when the ratchet is moved from the open position to the first-locked position. In some embodiments, the toggle lever remains in the blocking position to block the ratchet from moving to the over travel position to cause the striker to be blocked from moving downwardly toward the closed end of the fishmouth when the ratchet is being moved from the open position to the first-locked position.

In some embodiments, the ratchet upper tip rotates in the upward direction by about 0.2 millimeters to about 3 millimeters to cause the ratchet to move into the first locked position after the ratchet is blocked from moving to the over travel position. In some embodiments, the ratchet upper tip rotates in the upward direction by about 1.2 millimeters to cause the ratchet to move into the first locked position after the ratchet is blocked from moving to the over travel position. In some embodiments, the toggle lever moves from the blocking position to the neutral position to allow the ratchet to move to the over travel position to cause the striker to be allowed to move downward toward the closed end of the fishmouth after the ratchet upper tip rotates upward.

According to another aspect of the present disclosure, a method of latching may include the steps of providing a housing defining a slot having an open top, a closed bottom, and a length between the open top and the closed bottom, a primary pawl, a secondary pawl, a ratchet, and a striker, operably attaching the primary pawl to the housing such that the primary pawl is arranged to move between a locked position and an unlocked position, operably attaching the secondary pawl to the housing such that the secondary pawl is arranged to move between a locked position and an unlocked position, operably attaching the ratchet to the housing such that the ratchet is arranged to move between a first-locked position, a second-locked position, an open position, and an over travel position, and receiving within the slot the striker.

In some embodiments, the method further includes the steps of operably attaching together the housing and a vehicle and operably attaching together the striker and a hood of the vehicle. In some embodiments, the method further includes the steps of retaining the ratchet in the first-locked position by the primary pawl while the primary pawl is in the locked position and allowing the ratchet to move to the over travel position to allow the striker to travel downwardly toward the closed bottom of the housing. In some embodiments, the method further includes the step of activating a pawl release to cause the primary pawl to move from the locked position to the unlocked position such that the ratchet moves from the first-locked position to the second-locked position and is retained in the second-locked position by the secondary pawl in response to the primary pawl moving to the unlocked position.

These and other features of the present disclosure will become more apparent from the following description of the illustrative embodiments.

BRIEF DESCRIPTION OF THE DRAWINGS

FIG. 10 is an elevated view of the illustrative latch system of FIG. 8;

FIG. 10A is a partial elevated view of a pin and a primary pawl included in the latch system;

FIG. 11 is an elevated view of the illustrative latch system of FIG. 8;

FIG. 11A is a partial elevated view of the pin and primary pawl included in the latch system;

FIG. 12 is an elevated view of the illustrative latch system of FIG. 8;

FIG. 12A is a partial elevated view of the pin and primary pawl included in the latch system;

FIG. 13 is an elevated view of the illustrative latch system of FIG. 8;

FIG. 13A is a partial elevated view of the pin and primary pawl included in the latch system;

DETAILED DESCRIPTION OF THE DRAWINGS

Figure 1:
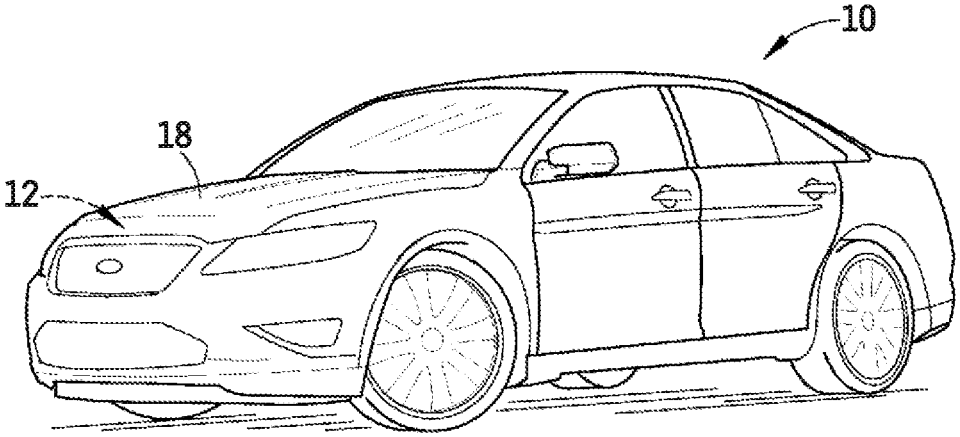
FIG. 1 is a front perspective view of a vehicle having an illustrative latch system.

For the purposes of promoting an understanding of the principles of the disclosure, reference will now be made to a number of illustrative embodiments illustrated in the drawings and specific language will be used to describe the same.

Figure 3:
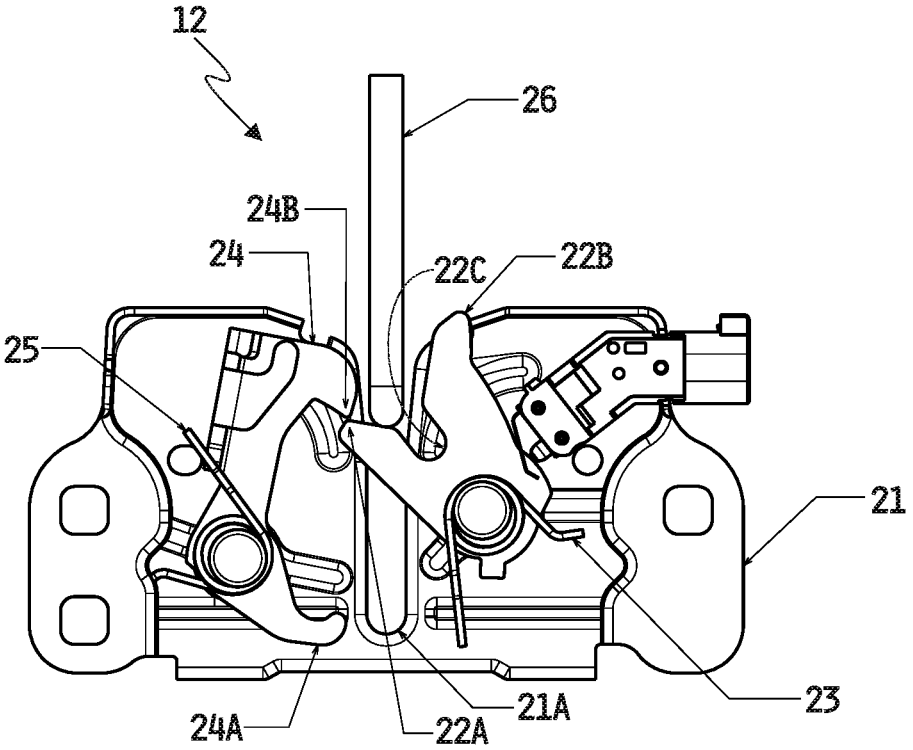
FIG. 3 is an elevated front view of an illustrative latch system.

For purposes of description herein, the terms "upper," "lower," "right," "left," "rear," "front," "vertical," "horizontal," and derivatives thereof shall relate to the illustrated device as oriented in FIG. 3. However, it is to be understood that the device may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, any specific dimensions and other physical characteristics relating to the embodiments disclosed herein are not to be considered as limiting, unless the claims expressly state otherwise.

Figure 2:
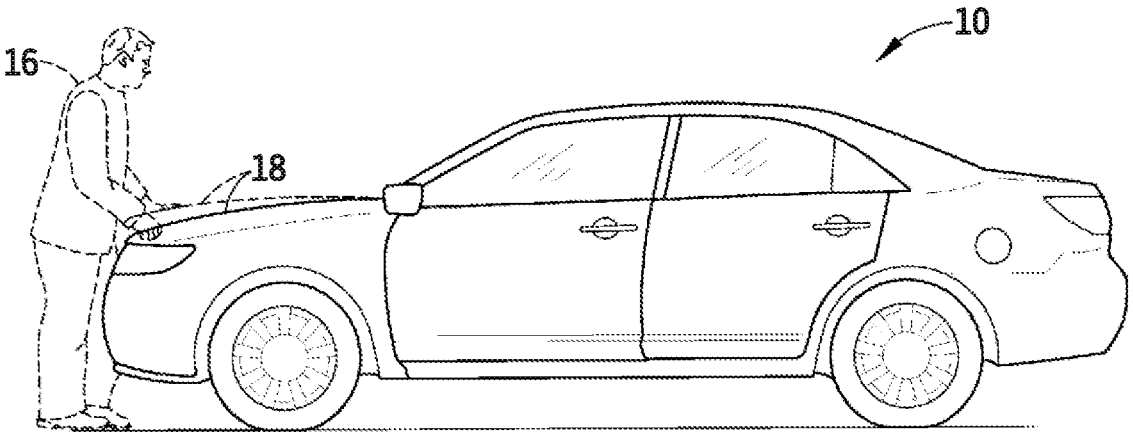
FIG. 2 is an elevated side view of the vehicle and a pedestrian colliding.

Referring to FIGS. 1 and 2, an illustrative vehicle, for example an automobile 10 is illustrated having a hood 18 that is operably connected to a front region of the automobile 10. The hood 18 is illustratively hingedly attached to the automobile 10 about a rear portion of the hood 18. The hood 18 is movable between a secured position or closed position, and an unsecured position or open position.

Figure 4:
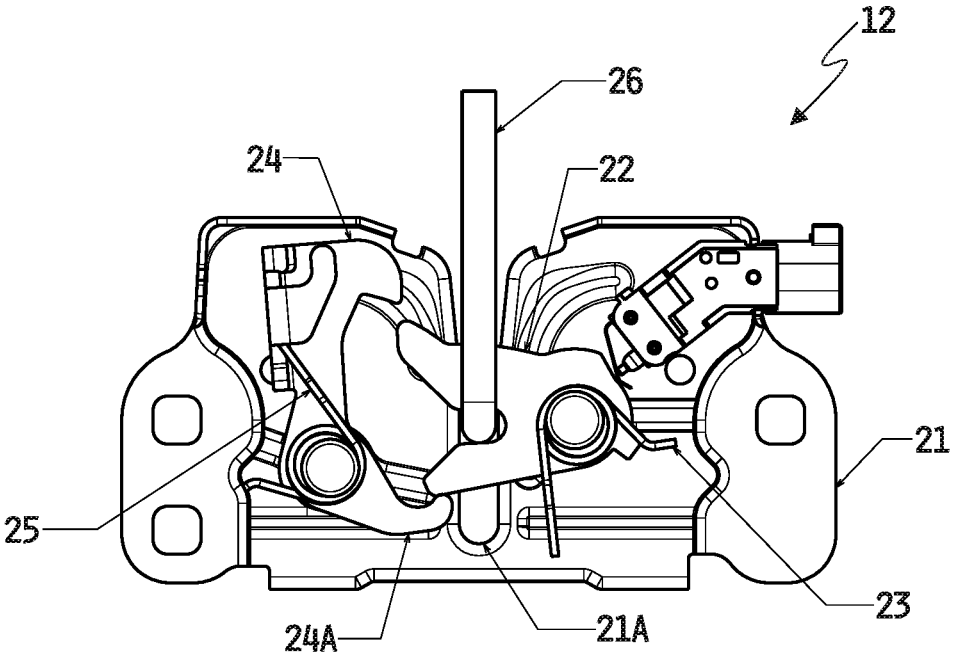
FIG. 4 is an elevated front view of the illustrative latch system of FIG. 3.

Referring to FIG. 3, as the hood closes, the striker 26 contacts the ratchet 22 causing the ratchet 22 to overcome the normal upward or counter-clockwise force of the bias member 23 to rotate the ratchet 22 downwardly away from the hood 18 into the closed position (FIG. 4). As the ratchet 22 rotates, the ratchet lower tip 22A contacts the pawl upper tip 24B causing the pawl 24 to overcome the clockwise force of the bias member 25. The housing 21 fishmouth 21A illustratively defines a length that is relatively longer than a conventional fishmouth. This longer fishmouth 21A allows the striker 26 to travel past the closed position to an over travel position during an impact with an object, such as for example a pedestrian 16. The ratchet is normally biased in the open position. Illustratively, the pawl is normally biased in the locking position. Illustratively, the bias members 23, 25 may comprise torsion springs.

Figure 5:
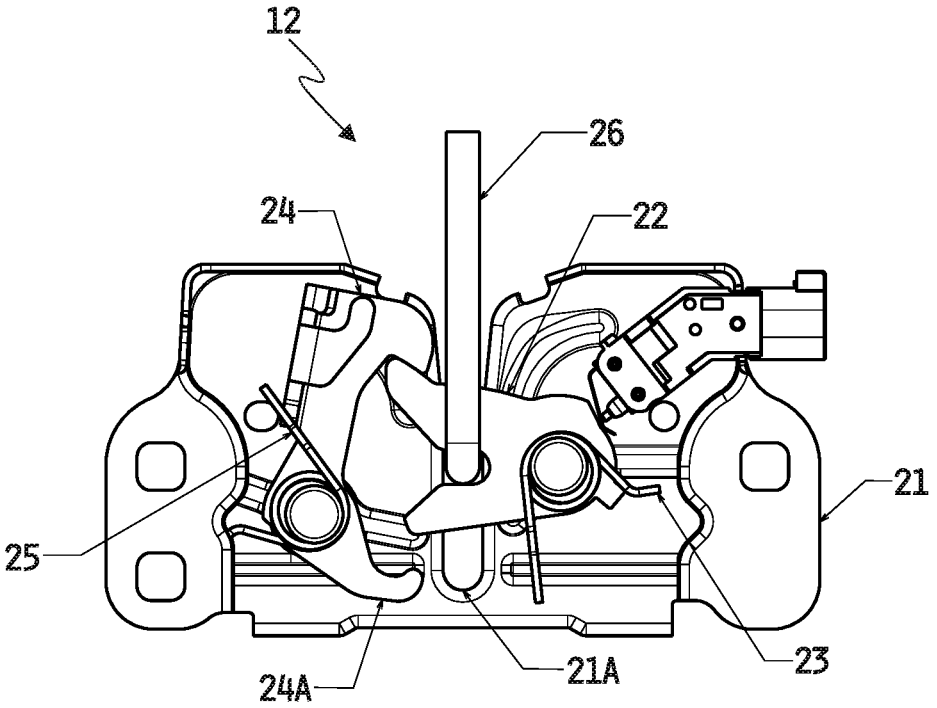
FIG. 5 is an elevated front view of the illustrative latch system of FIG. 3.

Referring to FIG. 4, as the pawl 24 rotates temporarily to the normal unlocked position, the pawl appendage, extension or tip 24A illustratively rotates into the path of the ratchet rotation which temporarily stops the ratchet rotation at the closed position wherein the striker 26 is fully seated within the mouth 22C of the ratchet. After the ratchet 22 is temporarily stopped by the pawl 24 as shown in FIG. 4, the bias member 25 urges the pawl 24 toward the locking position and the bias member 23 urges the ratchet 22 toward the open position. The bias member 25 rotates the pawl 24 into the locking position faster than the bias member 23 rotates the ratchet 22 to the open position. As a result, the bias member 25 and the bias member 23 are configured such that, after the ratchet 22 is temporarily stopped by the tip 24A, the bias member 25, having an exerting speed that is greater than an exerting speed of the bias member 23, urges the pawl 24 to the locking position to cause the pawl 24 to rotate and engage the ratchet 22 with the upper tip of the pawl 24 and hold the ratchet 22 in the closed position, as shown in FIG. 5, before the bias member 23 is able to rotate the ratchet 22 to the open position. In one example, the spring constants of the bias member 25 and the bias member 23 are configured to cause the pawl 24 to rotate and engage the ratchet 22 and hold the ratchet 22 in the closed position before the bias member 23 is able to rotate the ratchet 22 to the open position. Illustratively, the movement of the pawl 24 to this locking position, locks the ratchet 22 in the closed position and stops the striker 26 and hood 18 travel at the closed position as shown in FIG. 5. This temporary blocking of the ratchet 22 shown in FIG. 4 prevents excessive hood travel during closing of the hood 18 in normal operation during movement from the open or unsecured position to the closed or secured position.

Referring to FIG. 5, the illustrative closed and locked position of the ratchet 22, with the striker in the fully seated position within the mouth 22C is depicted. So, too, the hood 18 would be in the closed position. The pawl is in the locking position. The bias member or pawl spring 25 illustratively biases the pawl 24 in the engagement position. The bias member or ratchet spring 23 illustratively biases the ratchet 22 in the full open position. In the normal locked position, the pawl spring 25 rotates the pawl 24 into the full engagement position. The force of the pawl 24 against the ratchet 22 overcomes the bias of the ratchet spring 23 to hold the ratchet 22 in the closed position. The ratchet spring 23 rotates the ratchet 22 past the slight over-stroke position and into full engagement with the pawl 24.

Figure 6:
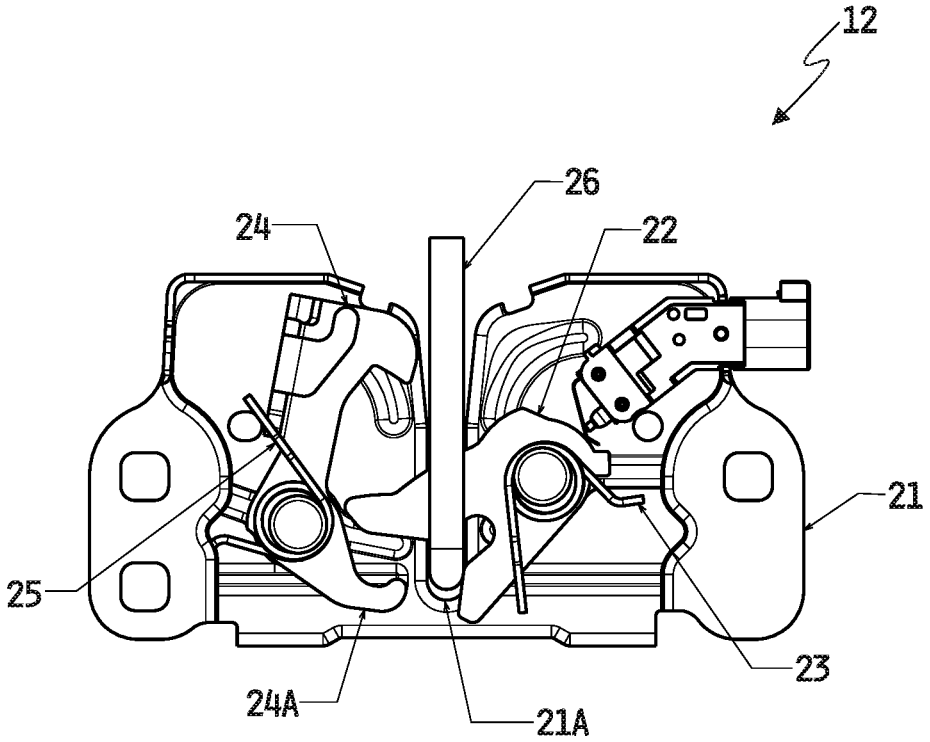
FIG. 6 is an elevated front view of the illustrative latch system of FIG. 3.

In illustrative operation of the illustrative system 12 during an impact between the hood and an object, such as for example a pedestrian 16, the striker 26 moves within the slot 26 as shown in FIG. 6, thereby absorbing at least a portion of the energy of the impact, which illustratively reduces injury to the illustrative impacted pedestrian. The pawl extension 24A illustratively does not prevent the ratchet 22 from rotating, nor does it inhibit the striker 26 from translating downwardly toward the bottom of the slot 26 in an over travel position during an impact with an object 16. The over travel position is further downwardly in the slot than the closed position which is at an intermediate length down the slot.

Figure 7:
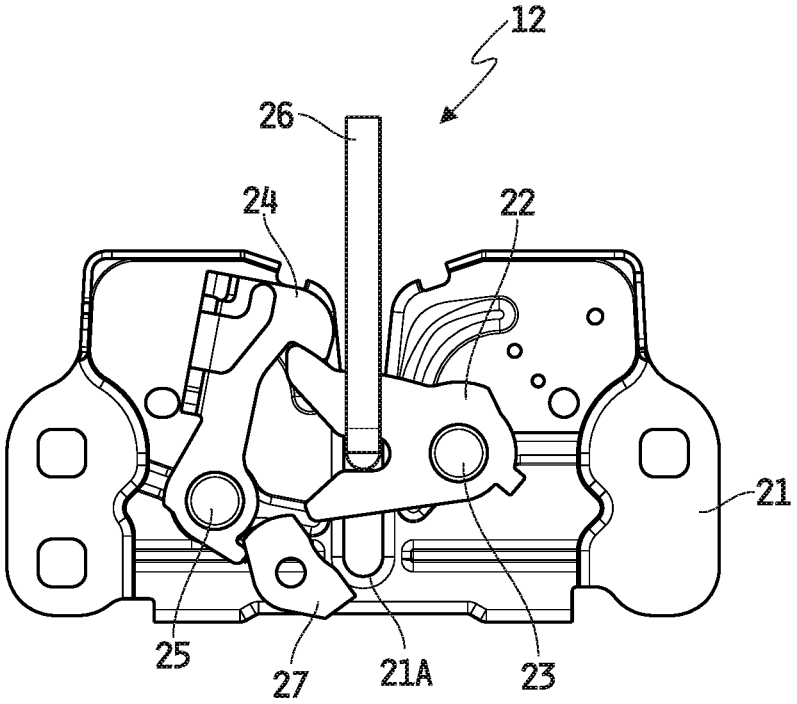
FIG. 7 is an elevated front view of another illustrative latch system.

Referring to FIG. 7 another illustrative embodiment of a latch system 12 is depicted. As the hood 18 closes, the striker 26 contacts the ratchet 22 causing the ratchet 22 to rotate. As the ratchet 22 rotates, the ratchet tip contacts the pawl tip causing the pawl 24 to rotate. As the pawl 24 rotates, the pawl 24 rotates the block lever 27 into the path of the ratchet 22 as it rotates in order to stop the ratchet 22 from rotating. This stops the striker 26 and hood 18 travel which prevents excessive hood travel during closure in normal operation. The pawl spring 25 rotates the pawl 24 into the full engagement position or the locking position. The ratchet spring 23 rotates the ratchet 22 past the slight over stroke and into full engagement with the pawl 24 in the closed position. The block lever 27 does not prevent the ratchet 22 rotation or inhibit the striker 26 travel to the over travel position or hood 18 travel during an impact with an object such as for example a pedestrian 16. During an impact with such an illustrative pedestrian, the striker 26 is free to move downwardly in the fishmouth 21A into the over travel position thereby absorbing energy from the collision. This absorption illustratively reduces injury to the pedestrian.

Illustratively, the automobile 10 is configured to include at least one latch system 12 that illustratively is configured to absorb or dissipate energy during various types of collisions between an object 16 and the automobile or vehicle 10. Illustratively, the object 16 involved in a collision with the vehicle 10 may be for example and without limitation a pedestrian 16 located proximate a front location of the automobile 10.

Illustratively, the automobile 10 is also configured to include the latch, latch assembly, or system 12 that may be described as an energy absorbing system or mechanism 12. When the hood 18 is in a secured position, or closed position, the latch system 12 is configured to allow the striker 26 to move downwardly out of the closed position wherein it is fully seated within the mouth 22C of the ratchet 22 in the closed position to an extended or over travel position. Whereas the striker 26 when fully seated within the mouth 22C when the ratchet is in the closed position is at a location within the fishmouth or slot 21A intermediate between the open end and the closed end of the slot 21A, the over travel position is further downwardly in the fishmouth 21A toward its closed bottom end. Similarly, the pawl and ratchet each over rotate to allow the striker to move to the over travel position. The over travel translation of the striker within the fishmouth toward the bottom of the fishmouth allows the latch system to absorb at least a portion of the energy from a collision between the vehicle and an object.

Illustratively, the striker 26 is configured in a substantially U- or C-shaped geometry that extends downwardly and away from a striker base or other mount. An illustrative striker base is typically of a substantially planar geometry having a bottom surface and a top surface. The striker 26 illustratively is operably connected to the underside of a hood 18, either directly or through the mounting plate.

Figure 8:
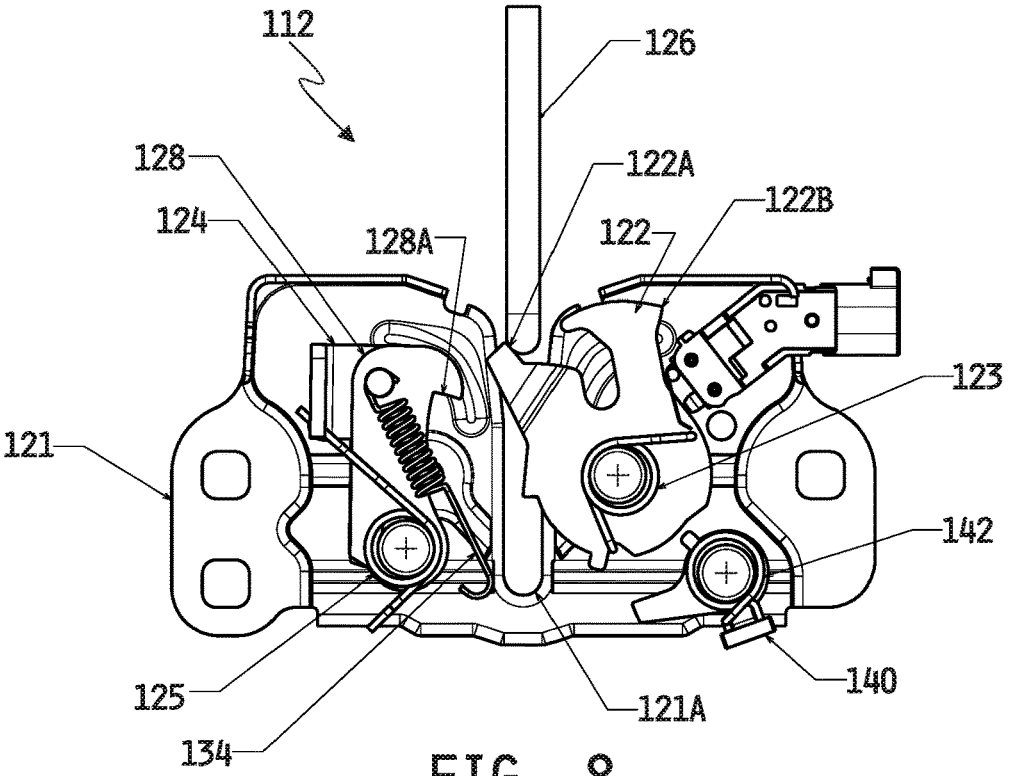
FIG. 8 is an elevated front view of another illustrative latch system.

Referring to FIG. 8 another illustrative embodiment of a latch system 112 is depicted. The latch system 112 is movable between a fully closed position, a partially closed position, and an open position. In the fully closed position, the hood 18 is fully closed relative to the body of the vehicle 10 and retained in position by the latch system 112 as shown in FIG. 10. In the partially closed position, the hood 18 is partially closed relative to the body of the vehicle 10 such that the a front of the hood 18 is spaced apart from the body of the vehicle 10 and retained in position by the latch system 112 as shown in FIG. 11. In the open position, the hood 18 is uncoupled from the latch system 112 as shown in FIG. 8.

Figure 9:
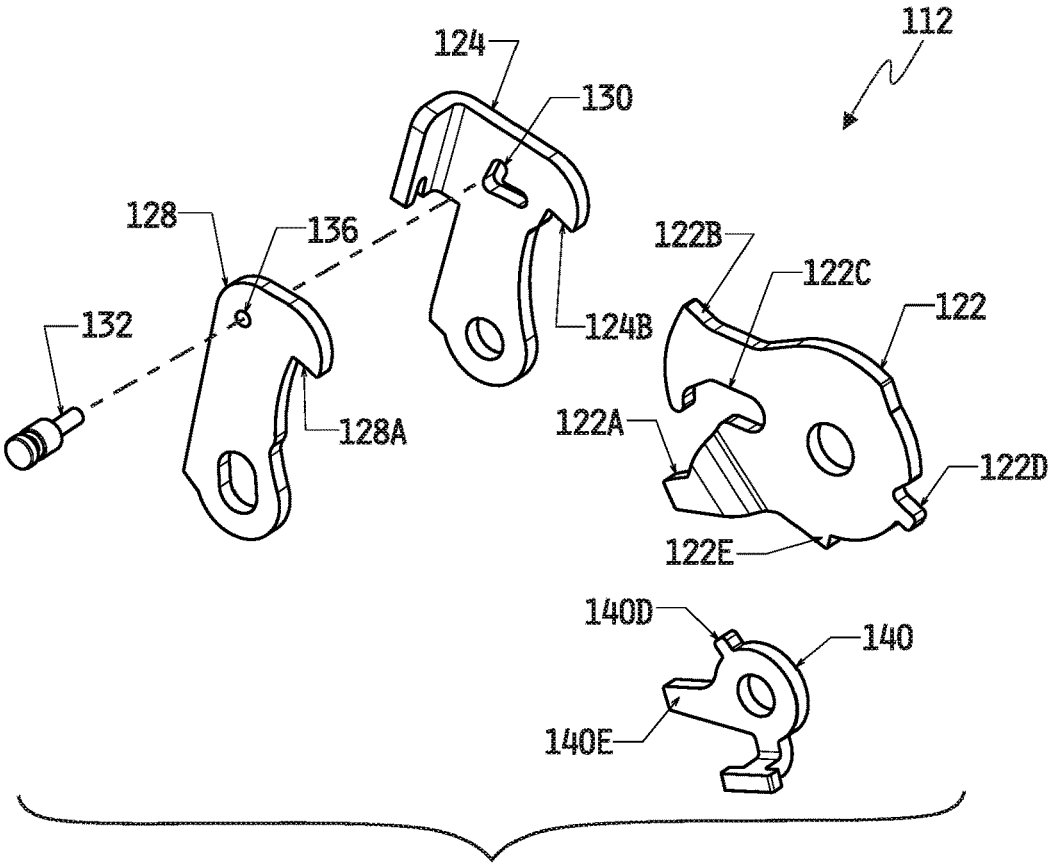
FIG. 9 is an exploded view of the illustrative latch system of FIG. 8.

Referring to FIGS. 8 and 9, in the illustrative embodiment, the latch system 112 includes a ratchet 122, a primary pawl 124, a secondary pawl 128, a pin 132, a striker 126, and a housing 121. The housing 121 includes a fishmouth 121A. The fishmouth defines a length between an open top end of the fishmouth 121A and a closed bottom end of the fishmouth 121A. The housing 121 fishmouth 121A illustratively defines a length that is longer than a conventional fishmouth. This longer fishmouth 121A allows the striker 126 to travel past a closed position to an over travel position during an impact with an object, such as for example a pedestrian 16.

The ratchet 122 engages the striker 126 and one of the primary and secondary pawls 124, 128 to retain the hood 18 in position relative to the body of the vehicle 10. The ratchet 122 is rotatably coupled to the housing 121 about a ratchet axis as shown in FIG. 10. The ratchet 122 is movable between a first-locked position, a second-locked position, an unlocked position, and an over travel position. The ratchet 122 is biased in a clockwise direction by a ratchet bias member 123 into the unlocked position as shown in FIG. 8. In the illustrative embodiment, the ratchet bias member 123 is a torsion spring. The ratchet 122 includes a ratchet upper tip 1228 arranged to engage the primary pawl 124 and a ratchet lower tip 122A arranged to engage the secondary pawl 128. The ratchet upper tip 1228 is axially spaced apart from the ratchet lower tip 122A relative to the ratchet axis.

Referring to FIG. 10, the primary pawl 124 is arranged to engage the ratchet 122 to retain the ratchet 122 in the first-locked position. The primary pawl 124 is movable between a locked position and an unlocked position. The primary pawl 124 is rotatably coupled to the housing 121 about a pawl axis. The primary pawl 124 is biased in a clockwise direction by a primary bias member 125 into the locked position. In the illustrative embodiment, the primary bias member 125 is a torsion spring. The primary pawl 124 includes a pawl tip 124A arranged to engage the ratchet upper tip 1228 to retain the ratchet 122 in the first-locked position. The primary pawl 124 is formed to include a primary slot 130 as shown in FIG. 9. In the illustrative embodiment, the primary slot 130 is generally L-shaped and receives the pin 132.

The primary pawl 124 is coupled to a pawl release. When activated, the pawl release pulls the primary pawl 124 in the counter-clockwise direction to cause the primary pawl 124 to overcome the clockwise force caused by the primary bias member 125 so that the primary pawl 124 rotates about the pawl axis in the counter-clockwise direction into the unlocked position. When the pawl release is deactivated, the clockwise force caused by the primary bias member 125 causes the primary pawl 124 to rotate about the pawl axis to return to the locked position.

Referring to FIG. 11, the secondary pawl 128 is arranged to engage the ratchet 122 to retain the ratchet 122 in the second-locked position. The secondary pawl 128 is movable between a locked position and an unlocked position. The secondary pawl 128 is rotatably coupled to the housing 121 about the pawl axis as shown in FIG. 10. The secondary pawl 128 is axially spaced apart from the primary pawl 124 relative to the pawl axis toward the ratchet lower tip 122A and away from the ratchet upper tip 1228. The secondary pawl 128 is biased in a clockwise direction by a secondary bias member 134 into the locked position. The secondary pawl 128 is biased downwardly toward the fishmouth 121A. In the illustrative embodiment, the secondary pawl 128 is biased downwardly by the secondary bias member 134. In the illustrative embodiment, the secondary bias member 134 is a tension spring.

The secondary pawl 128 includes a pawl tip 128A arranged to engage the ratchet lower tip 122A to retain the ratchet 122 in the second-locked position. The secondary pawl 128 is formed to include a secondary hole 136 as shown in FIG. 9. In the illustrative embodiment, the secondary hole 136 receives the pin 132.

Referring to FIG. 9, the pin 132 extends through the primary slot 130 and the secondary hole 136 to selectively couple together the primary pawl 124 and the secondary pawl 128. The pin 132 is movable between a lower right position shown in FIG. 11A, a lower left position shown in FIG. 10A, and an upper position shown in FIG. 13A. When the pin 132 is in one of the lower left and lower right positions, the primary pawl 124 is free to rotate about the pawl axis relative to the secondary pawl 128. When the pin 132 is in the upper position, the primary pawl 124 is coupled to the secondary pawl 128 such that rotation of the primary pawl 124 about the pawl axis causes the secondary pawl 128 to overcome the clockwise force caused by the secondary bias member 134 and rotate with the primary pawl 124 relative to the housing 121.

Figure 15:
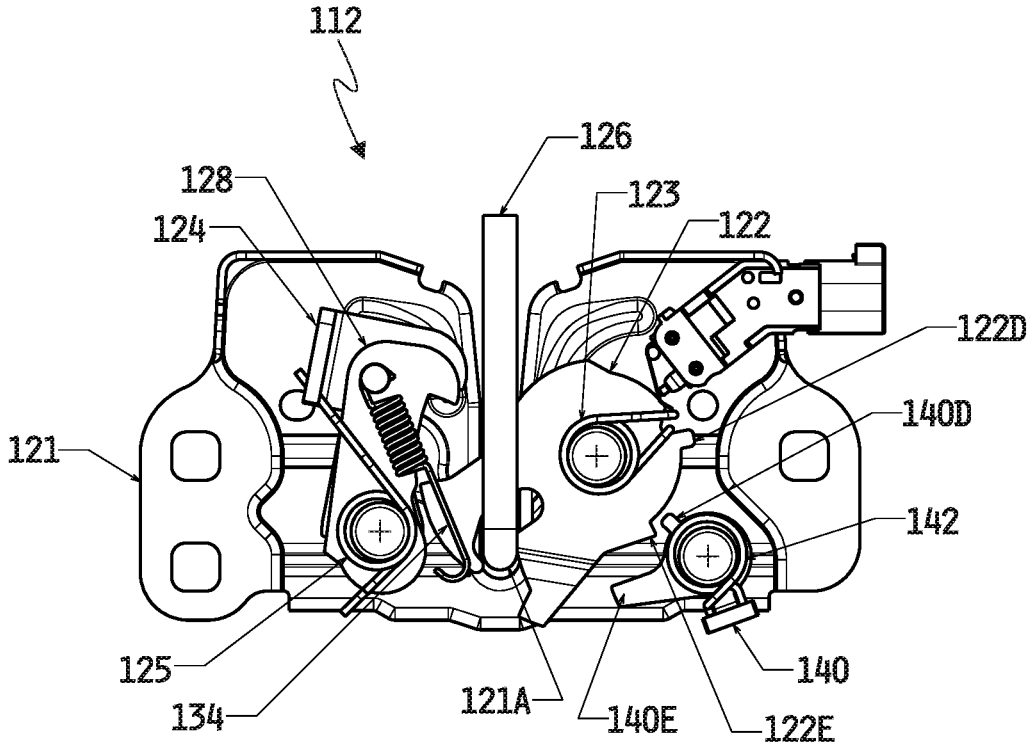
FIG. 15 is an elevated view of the illustrative latch system of FIG. 8.

The striker 126 is movable between an open position shown in FIG. 8, the closed position shown in FIG. 10, a partially closed position shown in FIG. 11, and the over travel position shown in FIG. 15. The relatively longer fishmouth 121A allows the striker 126 to travel past the closed position to the over travel position during an impact with an object, such as for example a pedestrian 16. Illustratively, the striker 126 is configured in a substantially U- or C-shaped geometry that extends downwardly and away from a striker base or other mount. An illustrative striker base is typically of a substantially planar geometry having a bottom surface and a top surface. The striker 126 illustratively is operably connected to the underside of a hood 18, either directly or through the mounting plate.

Operation of the latch system 112 is shown in FIGS. 8-15. Referring to FIG. 8, the latch system 112 is in the open position with the ratchet 122 in the unlocked position. As the hood 18 closes, the striker 126 contacts the ratchet 122 causing the ratchet 122 to overcome the clockwise force caused by the ratchet bias member 123 to rotate the ratchet 122 about the ratchet axis in a counter-clockwise direction away from the hood 18 and into the first-locked position (FIG. 10). With the ratchet 122 in the first-locked position, the clockwise force of the primary bias member 125 causes the primary pawl 124 to rotate about the pawl axis in the clockwise direction to engage the ratchet upper tip 1228 to retain the ratchet 122 in the first-locked position such that the latch system 112 is in the fully closed position.

Referring to FIG. 10, the latch system 112 is in the fully closed position. The striker 126 is in the closed position and fully seated within a mouth 122C of the ratchet 122, the ratchet 122 is in the first-locked position, the primary pawl 124 is in the locked position, and the secondary pawl 128 is in the locked position. As shown in FIG. 10A, when the latch system 112 is in the fully closed position, the pin 132 is in the lower left position such that the primary pawl 124 is free to rotate about the pawl axis relative to the secondary pawl 128.

Referring to FIGS. 10 and 11, to move the latch system 112 from the fully closed position (FIG. 10) to the partially closed portion (FIG. 11), the pawl release is activated a first time such that the primary pawl 124 overcomes the clockwise force caused by the primary bias member 125 to rotate the primary pawl 124 about the pawl axis in the counter-clockwise direction. As the primary pawl 124 rotates in the counter-clockwise direction, the pawl tip 124A of the primary pawl 124 disengages the ratchet upper tip 1228. With the pawl tip 124A disengaged from the ratchet upper tip 1228, the clockwise force caused by the ratchet bias member 123 causes the ratchet 122 to rotate in the clockwise direction toward the hood 18 and into the second-locked position. The ratchet lower tip 122A engages the pawl tip 128A of the secondary pawl 128 to retain the ratchet 122 in the second-locked position.

Referring to FIG. 11, the latch system 112 is in the partially closed position. The striker 126 is seated within the fishmouth 121A in the partially closed position, the ratchet 122 is in the second-locked position, the primary pawl 124 is in the unlocked position, and the secondary pawl 128 is in the unlocked position. As shown in FIG. 11A, when the latch system 112 is in the partially closed position and before the pawl release has been deactivated, the pin 132 is in the lower right position such that the primary pawl 124 is free to rotate about the pawl axis relative to the secondary pawl 128 and the secondary pawl 128 is blocked from moving upward toward the hood 18 in response to the upward force caused by the ratchet 122.

Referring to FIG. 12, the pawl release has been deactivated and the clockwise force of the primary bias member 125 causes the primary pawl 124 to rotate in the clockwise direction about the pawl axis and return to the primary-locked position. As the primary pawl 124 rotates in the clockwise direction, the pin 132 moves in the primary slot 130 from the lower right position toward the lower left position as suggested in FIG. 12A. When the primary pawl 124 returns to the primary-locked position, the pin 132 is momentarily in the lower left position until the upward force of the ratchet 122 causes the secondary pawl 128 to overcome the downward force caused by the secondary bias member 134 and move upward relative to the primary pawl 124 as shown in FIG. 13. The upward movement of the secondary pawl 128 causes the pin 132 to move to the upper position as shown in FIG. 13A. In the upper position, the pin 132 couples the primary pawl 124 to the secondary pawl 128 for rotational movement therewith.

Referring to FIG. 13, the latch system 112 is in the partially closed position. To move the latch system 112 from the partially closed position (FIG. 13) to the open position (FIG. 8), the pawl release is activated a second time such that the primary pawl 124 overcomes the clockwise force caused by the primary bias member 125 to rotate the primary pawl 124 in the counter-clockwise direction. The secondary pawl 128 is rotatably coupled to the primary pawl 124 by the pin 132 and the secondary pawl 128 rotates in the counter-clockwise direction with the primary pawl 124.

As the secondary pawl 128 rotates in the counter-clockwise direction, the pawl tip 128A of the secondary pawl 128 disengages the ratchet lower tip 122A. The clockwise force caused by the ratchet bias member 123 causes the ratchet 122 to rotate in the clockwise direction toward the hood 18 and into the unlocked position. With the ratchet 122 in the unlocked position, the latch system 112 is in the open position and the hood 18 is free to rotate upwardly relative to the latch system 112. The pawl release is deactivated and the primary bias member 125 causes the primary pawl 124 to rotate in the clockwise direction and into the locked position and the secondary bias member 134 causes the secondary pawl 128 to rotate in the clockwise direction and downwardly away from the hood 18 into the locked position.

Figure 14:
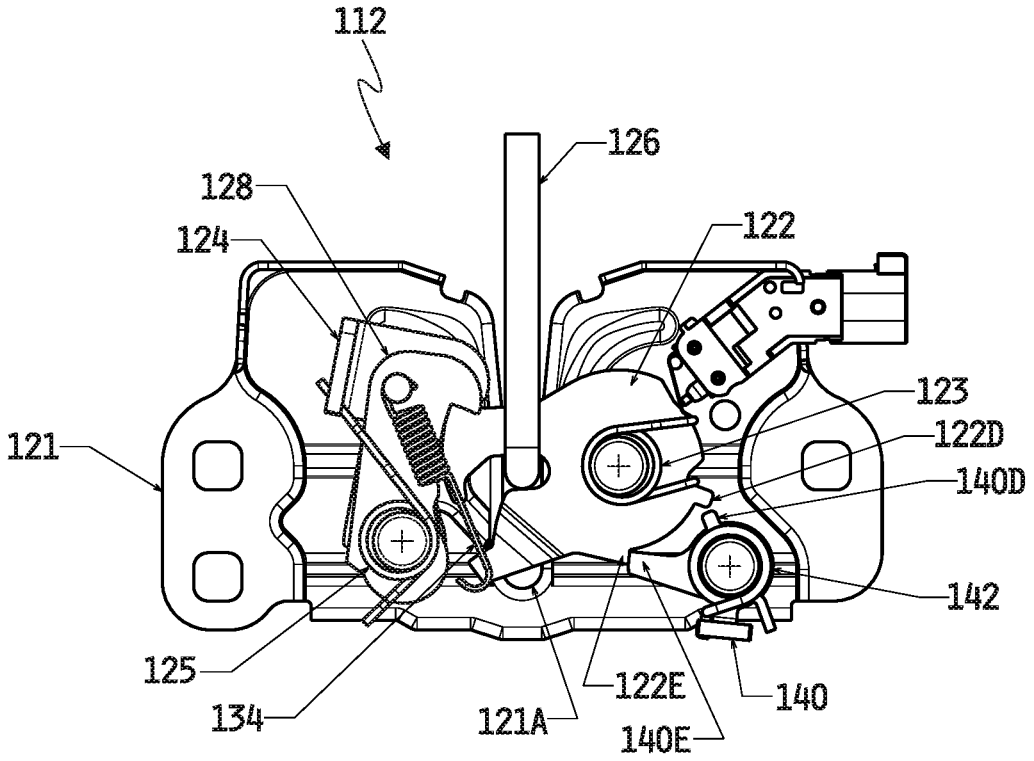
FIG. 14 is an elevated view of the illustrative latch system of FIG. 8.

Referring to FIGS. 14 and 15, the latch system 112 further includes a toggle lever 140 and a toggle bias member 142. The toggle lever 140 is rotatably coupled to the housing 121 about a toggle axis as shown in FIG. 14. The toggle lever 140 is movable between a neutral position shown in FIG. 15, a blocking position shown in FIG. 14, and a bypass position. In the blocking position, the toggle lever 140 is rotated in the clockwise direction about the toggle axis from the neutral position. In the bypass position, the toggle lever 140 is rotated in the counter-clockwise direction about the toggle axis from the neutral position. The toggle lever 140 is biased into the neutral position by a toggle bias member 142 from both the blocking position and the bypass position. In the illustrative embodiment, the toggle bias member 142 is a torsion spring.

Referring to FIG. 14, in the illustrative embodiment, the toggle lever 140 includes a toggle switch 140D and a toggle bumper 140E. The toggle switch 140D is arranged to engage the ratchet 122 to rotate the toggle lever 140 about the toggle axis. The ratchet 122 further includes a toggle mover 122D and a ratchet bumper 122E. The toggle mover 122D is arranged to engage the toggle switch 140D and apply a force to the toggle lever 140 to rotate the toggle lever 140 about the toggle axis. When the hood 18 is being closed from the open position, the ratchet 122 and the toggle lever 140 cooperate to block the striker 126 from over travel in the fishmouth 121A and, thus, block the striker 126 from contacting the bottom of the housing.

When the hood 18 is being closed, the striker 126 translates downwardly in the fishmouth 121A and contacts the ratchet 122. The force of the striker 126 overcomes the bias force caused by the ratchet bias member 123 to cause the ratchet 122 to rotate in the counter-clockwise direction. In some embodiments, the ratchet upper tip 1228 travels about 0.2 millimeters to about 3 millimeters past the first-locked position. In the illustrative embodiment, the ratchet upper tip 1228 travels about 1.2 millimeters past the first-locked position. As the ratchet 122 rotates, the toggle mover 122D of the ratchet 122 engages the toggle switch 140D of the toggle lever 140 and the force of the ratchet 122 causes the toggle lever 140 to move from the neutral position (shown in FIG. 8) to the blocking position (shown in FIG. 14).

The ratchet bumper 122E engages the toggle bumper 140E to cause the toggle lever 140 to block the ratchet 122 from further rotation in the counter-clockwise direction to cause the mouth 122C of the ratchet 122 to block the striker 126 from translating downward and contacting the fishmouth 121A as shown in FIG. 14. The force of the ratchet bias member 123 then causes the ratchet 122 to rotate clockwise such that the ratchet 122 is moved to the first-locked position and is retained in position by the primary pawl 124. In some embodiments, the ratchet upper tip 122B travels in the upward direction by about 0.2 millimeters to about 3 millimeters when the ratchet 122 moves into the first-locked position. In the illustrative embodiment, the ratchet upper tip 122B travels in the upward direction by about 1.2 millimeters when the ratchet 122 moves into the first-locked position. When the ratchet 122 moves to the first-locked position, the ratchet bumper 122E disengages the toggle bumper 140E of the toggle lever 140 and the force of the toggle bias member 142 causes the toggle lever 140 to return to the neutral position to allow the striker 126 to over travel if an impact occurs. As such, the latch system 112 is in the fully closed position and the hood 18 is closed.

In the bypass position, the ratchet 122 is free to rotate past the toggle lever 140. When the ratchet 122 is moved from the first-locked position to the second-locked position, such as when the hood 18 is being opened, the toggle mover 122D of the ratchet 122 engages the toggle switch 140D of the toggle lever 140 and the force of the ratchet 122 causes the toggle lever to rotate in the counter-clockwise direction and move to the bypass position. As the ratchet 122 further rotates in the clockwise direction, the ratchet 122 disengages the toggle lever 140 and the force of the toggle bias member 142 causes the toggle lever 140 to return to the neutral position. As such, the latch system 112 is in the open position and the hood 18 is open.

Referring to FIG. 15, the ratchet 122 and toggle lever 140 cooperate to allow the striker 126 to over travel in the fishmouth 121A during an impact between the hood 18 and an object, such as for example a pedestrian 16. Before an impact, the hood 18 is closed such that the ratchet 122 is in the first-locked position and the toggle lever 140 is in the neutral position as shown in FIG. 10. As shown in FIG. 15, during an impact, the striker 126 moves within the slot, thereby absorbing at least a portion of the energy of the impact, which illustratively reduces injury to the illustrative impacted pedestrian. In some embodiments, the striker 126 moves in a downward direction by about 10 millimeters to about 30 millimeters into the over travel position relative to the closed position of the striker 126. In the illustrative embodiment, the striker 126 may move in the downward direction by about 20 millimeters into the over travel position relative to the closed position of the striker 126. As the toggle lever 140 is in biased into the neutral position, the toggle lever 140 illustratively does not prevent the ratchet 122 from rotating, nor does it inhibit the striker 126 from translating downwardly toward the bottom of the slot in an over travel position during an impact with an object 16.

Figure 16:
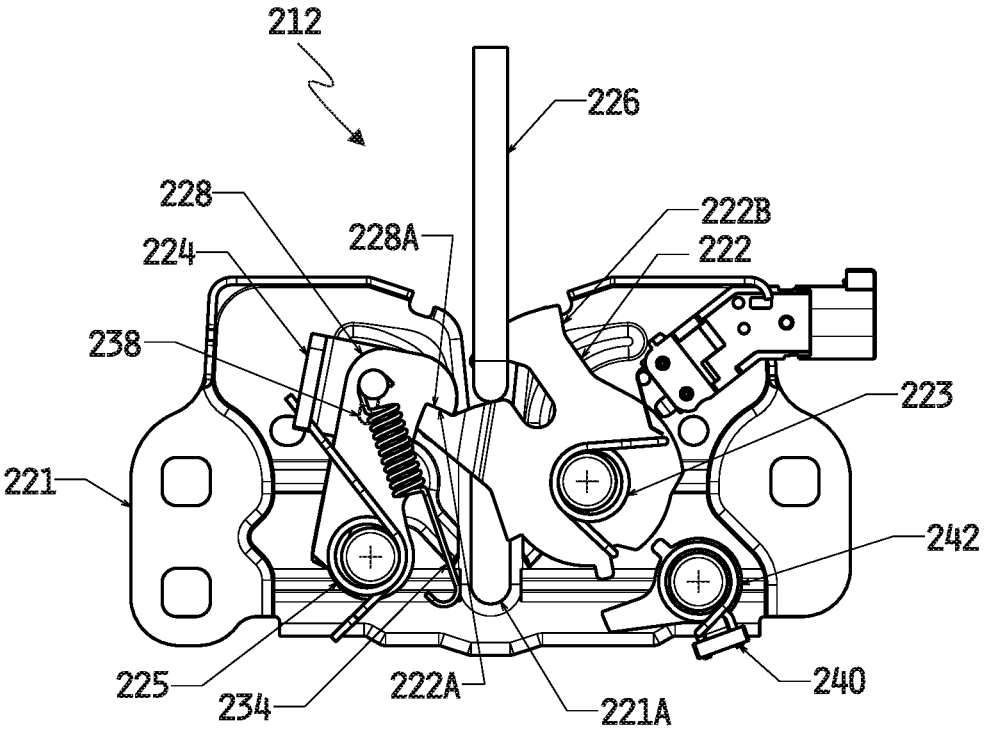
FIG. 16 is an elevated view of another illustrative latch system.

Another illustrative latch system 212 is shown in FIG. 16. The latch system 212 is configured for use in the vehicle 10 and is substantially similar to the latch system 112 shown in FIGS. 8-15 and described herein. Accordingly, similar reference numbers in the 200 series indicate features that are common between the latch system 112 and the latch system 212. The description of the vehicle 10 and the latch system 112 is hereby incorporated by reference to apply to the latch system 212, except in instances when it conflicts with the specific description and drawings of the latch system 212.

Referring to FIG. 16, the secondary pawl 228 is formed to include a secondary slot 238 that receives the pin 232. Illustratively, the secondary slot 238 has a shape similar to the vertical portion of the primary slot 230 of the primary pawl 224. The pin 232 extends through the primary slot 230 and the secondary slot 238 to selectively couple together the primary pawl 224 and the secondary pawl 228 as shown in FIG. 16.

The pin 232 is movable between a top position and a bottom position in the secondary slot 238. The pin 232 is biased toward the top position in the secondary slot 238. The secondary pawl 228 is biased in a clockwise direction by the secondary bias member 234 into the locked position. The secondary pawl 228 is biased downwardly toward the fishmouth 221A. When the pin 232 is in the one of the lower positions of the primary slot 230, the primary pawl 224 is free to rotate about the pawl axis relative to the secondary pawl 228. When the pin 232 is in the upper position of the primary slot 230, the primary pawl 224 is coupled to the secondary pawl 228 such that rotation of the primary pawl 224 about the pawl axis causes the secondary pawl 228 to rotate therewith.

In operation, the latch system 212 is moved from the open position to the fully closed position similar to the latch system 112. To move the latch system 212 from the fully closed position to the partially closed portion, the pawl release is activated a first time such that the primary pawl 224 overcomes the clockwise force caused by the primary bias member 225 to rotate the primary pawl 224 about the pawl axis in the counter-clockwise direction relative to the secondary pawl 128. As the primary pawl 224 rotates in the counter-clockwise direction, the pawl tip 224A of the primary pawl 224 disengages the ratchet upper tip 222B. With the pawl tip 224A disengaged from the ratchet upper tip 222B, the clockwise force caused by the ratchet bias member 223 causes the ratchet 222 to rotate in the clockwise direction toward the hood 18 and into the second-locked position. The ratchet lower tip 222A engages the pawl tip 228A of the secondary pawl 228 to retain the ratchet 222 in the second-locked position.

In the second-locked position, the ratchet 222 applies an upward force to the secondary pawl 228. The secondary slot 238 allows the upward force from the ratchet 222 to cause the secondary pawl 228 to move upward relative to the primary pawl 224 before the pawl release is deactivated. As the secondary pawl 228 moves upwards relative to the primary pawl 224, the pin 232 moves into the bottom position of the secondary slot 238.

The pawl release is deactivated and the clockwise force of the primary bias member 225 causes the primary pawl 224 to rotate in the clockwise direction about the pawl axis and return to the primary-locked position. As the primary pawl 124 rotates in the clockwise direction, the pin 232 moves in the primary slot 230 from the lower right position toward the lower left position.

When the primary pawl 224 returns to the primary-locked position, the pin 232 is momentarily in the lower left position until the upward bias force of the pin 232 causes the pin 232 to move upward relative to the primary pawl 124 into the upper position of the primary slot. In the upper position, the pin 232 couples the primary pawl 224 to the secondary pawl 228 for rotational movement therewith.

To move the latch system 212 from the partially closed position to the open position, the pawl release is activated a second time such that the primary pawl 224 overcomes the clockwise force caused by the primary bias member 225 to rotate the primary pawl 224 in the counter-clockwise direction. The pin 232 couples the primary pawl 127 and secondary pawl 128 together such that, as the primary pawl 224 rotates, the secondary pawl 128 overcomes the clockwise force caused by the secondary bias member 234 and rotates therewith. The pawl release is deactivated and the primary bias member 225 causes the primary pawl 224 to rotate in the clockwise direction and into the locked position and the secondary bias member 234 causes the secondary pawl 228 to rotate in the clockwise direction and downward into the locked position. The pin 232 returns to the lower left position in the primary slot 230 and the top position in the secondary slot 238.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A latch adapted for use with a vehicle hood, the latch comprising:

a housing formed to define a slot having an open top end and a closed bottom end, a striker configured to be received in the slot, a ratchet configured to rotate on a ratchet axis relative to the housing between an open position, a closed position, and an over travel position and to receive the striker in a mouth of the ratchet, and a pawl configured to rotate on a pawl axis relative to the housing between a locking position and an unlocked position and to selectively engage the ratchet to cause the ratchet to retain the striker in the slot, a first bias member coupled with the ratchet and the housing and configured to bias the ratchet towards the open position, a second bias member coupled with the pawl and the housing and configured to bias the pawl towards the locking position, wherein the ratchet and the pawl are sized such that, in response to the striker moving downwardly through the open top end of the slot, into the mouth of the ratchet, and toward the closed bottom end to close the latch, the ratchet rotates in a first direction about the ratchet axis from the open position towards the closed position and engages a first portion of the pawl, temporarily overcoming a bias force of the second bias member, and urges the pawl to rotate about the pawl axis from the locking position towards the unlocked position to cause a second portion of the pawl to temporarily engage the ratchet and block further rotation of the ratchet in the first direction about the ratchet axis to prevent excess travel of the striker in the slot, wherein the first bias member and the second bias member are configured such that, after the second portion of the pawl temporarily engages the ratchet, the second bias member rotates the pawl into the locking position faster than the first bias member rotates the ratchet to the open position to cause the first portion of the pawl to engage the ratchet before the first bias member rotates the ratchet to the open position so that the pawl holds the ratchet in the closed position, wherein, when the latch is closed such that the pawl is in the locking position and the ratchet is in the closed position, the ratchet is free to rotate in the first direction relative to the ratchet axis from the closed position to the over travel position to allow the striker to move downwardly toward the closed bottom end of the slot.

2. The latch of claim 1, wherein the ratchet includes a ratchet body, an upper ratchet tip that extends away from the ratchet body, and a lower ratchet tip that extends away from the ratchet body, the lower ratchet tip is spaced apart circumferentially relative to the ratchet axis from the upper ratchet tip to define the mouth of the ratchet, and wherein the pawl includes a pawl body, an upper pawl tip that extends away from the pawl body, and a lower pawl tip that extends away from the pawl body, and the lower pawl tip is spaced apart circumferentially relative to the pawl axis from the upper pawl tip.

3. The latch of claim 2, wherein the upper ratchet tip, the lower ratchet tip, the upper pawl tip, and the lower pawl tip are sized such that, in response to the striker moving downwardly through the open top end of the slot, into the mouth of the ratchet, and toward the closed bottom end to close the latch, the ratchet engages the upper pawl tip and urges the pawl to rotate about the pawl axis as the ratchet rotates in the first direction about the ratchet axis to cause the lower pawl tip to temporarily engage the lower ratchet tip and block further rotation of the ratchet in the first direction about the ratchet axis.

4. The latch of claim 1, wherein the ratchet is movable between the closed position in which the striker is retained in the slot and the open position in which the striker is free to exit the open top end of the slot, the pawl is movable between the locking position in which the pawl holds the ratchet in the closed position and the unlocked position in which the pawl permits rotation of the ratchet about the ratchet axis out of the closed position.

5. The latch of claim 4, wherein the pawl is spaced apart from the ratchet when the pawl is in the locking position and the ratchet is in the closed position so that the ratchet is free to rotate in the first direction and allow the latch to move downward into the slot toward the closed bottom end in response to a downward force being applied to the striker and a portion of the pawl is in a path of rotation of the ratchet when the pawl is in the unlocked position so that the portion of the pawl blocks rotation of the ratchet if the ratchet is rotated in the first direction.

6. The latch of claim 1, wherein the pawl axis is spaced apart from the ratchet axis to locate the slot between the pawl axis and the ratchet axis.

7. A latch comprising:

a housing having a fishmouth, the fishmouth defining a length between an open top end of the fishmouth and a closed bottom end of the fishmouth, a ratchet, a pawl, a first bias member, a second bias member, and a striker configured to be received within the fishmouth; and wherein the ratchet and the pawl cooperate to selectively retain the striker in the fishmouth, the ratchet movable between a closed position wherein the striker is retained in the fishmouth and an open position wherein the striker is free to exit the fishmouth, the pawl movable between a locking position wherein the pawl keeps the ratchet in the closed position and an unlocked position wherein the pawl permits movement of the ratchet out of the closed position, the ratchet being biased by the first bias member to the open position and the pawl being biased by the second bias member to the locking position; and wherein the pawl includes a lower appendage that, as the pawl rotates temporarily to the unlocked position during closing of the latch, rotates into a path of the ratchet rotation which temporarily stops rotation of the ratchet and blocks the ratchet from moving past the closed position, the second bias member, having an exerting speed that is greater than an exerting speed of the first bias member, thereafter biases the pawl to the locking position before the first bias member biases the ratchet to the open position thereby retaining the striker in the closed position, the closed position being an intermediate position between the open top end and the closed bottom end of the fishmouth, and wherein, after the ratchet is in the closed position and the pawl is in the locking position, the ratchet is rotatable out of the closed position to an over travel position to allow the striker to move downwardly toward the closed bottom end of the fishmouth.

8. The latch of claim 7, wherein the pawl includes a pawl body, an upper pawl tip that extends away from the pawl body, and a lower pawl tip that extends away from the pawl body and provides the lower appendage.

9. The latch of claim 8, wherein the ratchet includes a ratchet body, an upper ratchet tip that extends away from the ratchet body, and a lower ratchet tip that extends away from the ratchet body, the lower ratchet tip is spaced apart from the upper ratchet tip to define a mouth of the ratchet configured to receive the striker.

10. The latch of claim 9, wherein the lower pawl tip and the lower ratchet tip are sized such that the lower pawl tip is configured to move into the path of the ratchet rotation in response to rotation of the pawl by a predetermined amount.

11. The latch of claim 7, wherein the pawl is the only pawl configured to engage the ratchet.

* * * * *